United States Patent [19]

Brockelsby

[11] 3,939,793

[45] Feb. 24, 1976

[54] ANCHOR BRACKET AND CLEAT

[75] Inventor: Norman D. Brockelsby, Grand Island, Nebr.

[73] Assignee: Dutton-Lainson Company, Hastings, Nebr.

[22] Filed: Feb. 7, 1975

[21] Appl. No.: 547,862

[52] U.S. Cl. ..... 114/210; 114/218

[51] Int. Cl.[2] ..... B63B 21/22

[58] Field of Search ..... 114/.5 R, 210, 213, 217, 114/218; 9/1 R

[56] References Cited

UNITED STATES PATENTS

| | | | |
|---|---|---|---|
| 2,837,050 | 6/1958 | Frank | 114/210 |
| 3,126,858 | 3/1964 | Rosinski | 114/218 |
| 3,503,359 | 3/1970 | Cornwell, Jr. | 114/218 |

*Primary Examiner*—Trygve M. Blix
*Assistant Examiner*—Stuart M. Goldstein
*Attorney, Agent, or Firm*—Molinare, Allegretti, Newitt & Witcoff

[57] ABSTRACT

An anchor bracket and cleat includes spaced rings attached to a pair of parallel rods and inclined in opposite directions to define a cleat. An annular horn shaped collar member is attached to extensions from the rods and serves as an anchor bracket particularly useful in combination with a mushroom anchor.

7 Claims, 6 Drawing Figures

Fig. 1
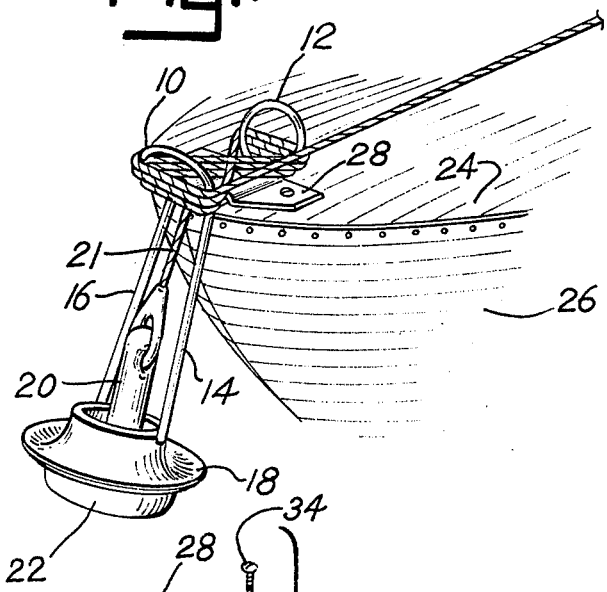
Fig. 2
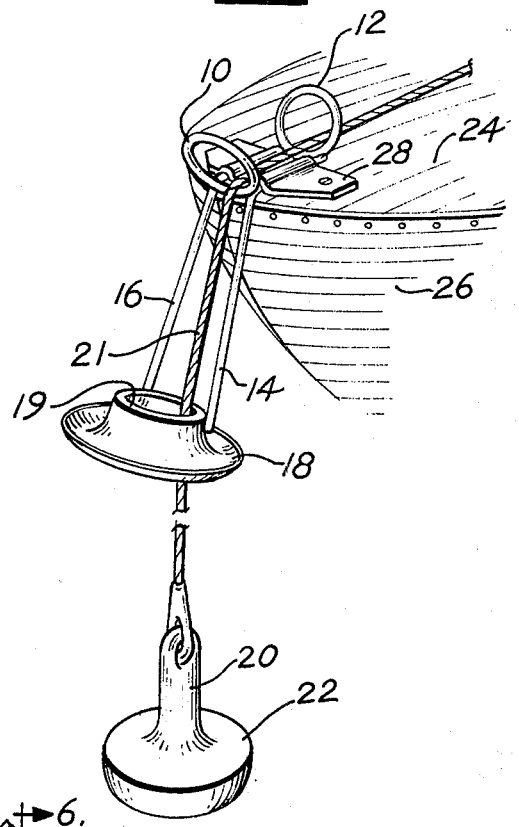
Fig. 3
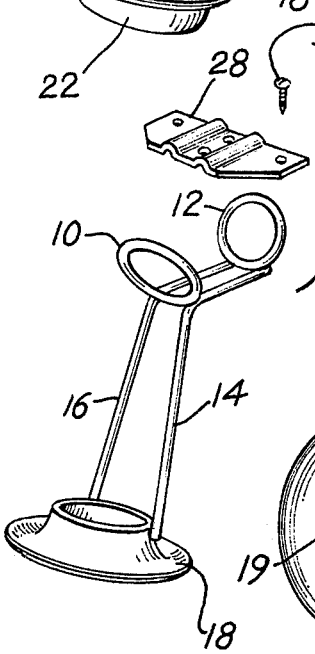
Fig 4
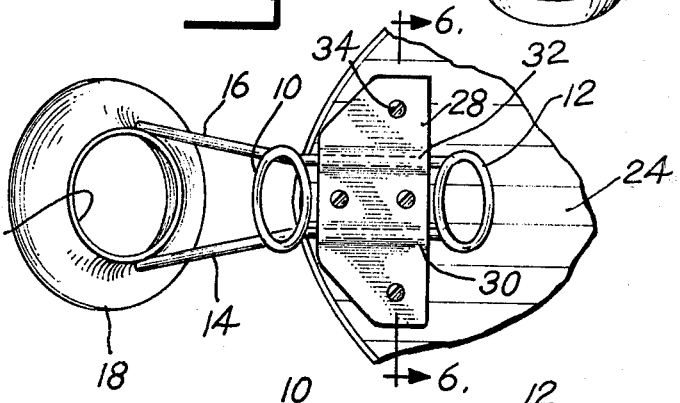
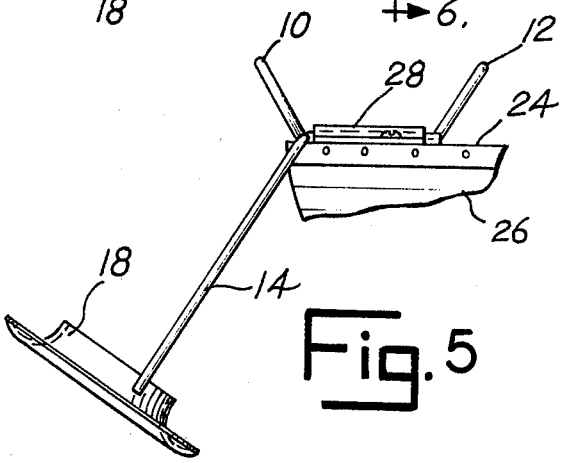
Fig. 5
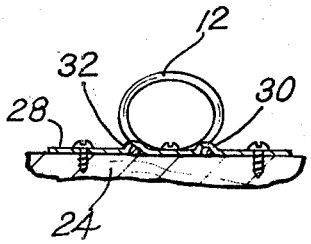
Fig. 6

ANCHOR BRACKET AND CLEAT

BACKGROUND OF THE INVENTION

This invention relates to an improved anchor bracket and cleat particularly useful for fishing boats and the like having a small deck space.

When fishing from a small boat, it is often desirable to anchor and cast a bait. If fishing efforts are not successful at a first anchorage, then it is common to move to successive anchorages in an effort to improve results. With each move, it is necessary to weigh anchor and then drop the anchor. In those instances where the anchor is retained inside the boat, pulling up the anchor each time may require coiling of the anchor rope and proper setting of the anchor in the boat. If these actions are not properly attended to, it is possible to foul the anchor line and, perhaps, the anchor, causing in some instances a hazard.

In an effort to obviate the problems associated with constant moving of a boat and attendant anchor movement, many boats now incorporate winch mechanisms for weighing the anchor as required. Such mechanisms work exceedingly well, though in many instances comprise a great expense, particularly for a pleasure fisherman. As a result, an anchor holder and guide is a desirable feature, particularly for small boats. Such a guide desirably includes a cleat mechanism or a gripping mechanism for the anchor rope to retain the rope in the event a locking winch is not used. Of particular desirability is an anchor bracket compatible with the popular mushroom anchor. These foregoing considerations, among others, prompted development of to the present invention.

SUMMARY OF THE INVENTION

In a principal aspect, the present invention comprises a combined anchor bracket and cleat including first and second opposed spaced rings joined to a common member and inclined in opposite directions from each other to form a cleat. An extension from the common member includes an attached collar member which receives an anchor rope. Thus, the anchor rope may be directed through the collar member and rings. The collar member is cooperative with an anchor. The entire structure is attached to a deck of a boat by a bracket.

Thus, it is an object of the present invention to provide a combination anchor bracket and cleat.

It is a further object of the present invention to provide an anchor bracket and cleat comprised of a pair of rings and a collar member all attached to a single support member with the rings forming the cleat.

Still another object of the present invention is to provide a combination anchor bracket and cleat including an annular horn shaped collar member for cooperation with a mushroom type anchor.

Still another object of the present invention is to provide an inexpensive yet sturdy and useful anchor bracket and cleat especially useful for boats having minimum deck space.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 1 is a perspective view of the improved anchor bracket and cleat of the present invention attached to a typical boat deck surface;

FIG. 2 is a perspective view similar to FIG. 1 wherein the anchor has been lowered;

FIG. 3 is an exploded perspective view of the invention;

FIG. 4 is a top plan view of the invention;

FIG. 5 is a side elevation of the invention; and

FIG. 6 is a cross-sectional view of the improved anchor bracket construction taken along the line 6—6 in FIG. 4.

DESCRIPTION OF THE PREFERRED EMBODIMENT

As shown in the Figures, the anchor bracket and cleat construction is comprised of a first metal ring 10 and a second metal ring 12. The rings 10 and 12 are welded to first and second metal rods 14 and 16, respectively. Rods 14 and 16 are arranged in nearly parallel fashion so that the rings 10 and 12 are arranged in opposed inclined relationship. The planes defined by the rings 10 and 12 intersect at a substantially 60° angle. This is the preferred value of the angle defined by the planes of rings 10 and 12. However, any desired angular relationship is possible so long as the rings 10 and 12 are inclined outwardly with respect to each other and with respect to the rods 14 and 16.

The diameter of the rings 10 and 12 is not a limiting feature of the invention. The diameter should be sufficient to enable passage of an anchor rope 21. Additionally, the rings 10, 12 should be of sufficient diameter and size to enable the anchor rope 21 to be wrapped thereabouts in order that the rings 10, 12 may serve as a cleat as shown in FIG. 1. Note also that the rings 10, 12 need not be circular in shape. Various other shapes such as a trapezoidal shape or the like will suffice in the performance of a function of the rings 10 and 12.

The rods 14 and 16 extend beyond the intermediate ring 10 and, as illustrated in the drawing, are angled downward from the deck surface 24 of the boat 26. The rods 14 and 16 terminate by attachment to an annular horn shaped collar 18. The collar 18 is flared outward and includes a center opening 19 sufficient for receipt of the stem portion 20 of a mushroom anchor 22. In this manner, the anchor line 21 may be drawn tightly to hold the anchor 22 against the collar 18, thereby preventing undesirable sway of the anchor during movement of the boat 26.

As mentioned previously, the collar 18 is preferably disposed downward toward the water surface. However, it is possible, because of the shape of the collar 18, to dispose of the collar 18 in other directions.

The rods 14 and 16 are attached to the deck surface 24 of boat 26 by a mounting plate 28. Plate 28 includes grooves 30 and 32 which receive the rods 14 and 16 respectively. The plate 28 thus fits over the rods 14 and 16 and maintains the bracket construction tightly on deck 24. Preferably, fasteners such as bolts, screws or the like 34 extend through the mounting plate 28 and attach to the deck surface 24. Preferably, the plate 28 extends across the rods 14 and 16 and in between the rods 14 and 16 so that fasteners 34 may be attached to the deck 24 on both sides of the rods 14 and 16.

In operation, anchor line 21 extends through collar 18 and rings 10 and 12 for connection to a winch, for example. To weigh anchor, the winch (not shown) is operated to draw the anchor 22 tightly against the collar 18. It is recommended that the anchor 22 be secured for travel by wrapping the rope 21 around the cleat formed by the rings 10 and 12 or by tying a half hitch around either one of the rings 10 or 12 so that the anchor 22 cannot creep down as the line or rope 21 stretches or compacts on the reel of the winch. Clearly, it is also possible to use the bracket construction of the present invention without a winch mechanism.

While in the foregoing there has been set forth a preferred embodiment of the present invention it is to be understood that equivalent constructions are to be included within the scope of the following claims.

What is claimed is:

1. An anchor bracket and cleat comprising, in combination:

support member means including first and second parallel, spaced rods;

first and second opposed spaced ring means joined to the support member means, said ring means being inclined in opposite directions and spaced from each other to form a cleat, said ring means including openings for guiding a line;

means for attaching the ring support member means to a deck surface; and an extension of said support member means, including first and second diverging rod extensions of said first and second rods, respectively, said rod extensions connected to a support collar member, being spaced from said ring means to form a separate anchor support, whereby an anchor may be retained by the collar member.

2. The combination of claim 1 wherein said collar member is comprised of an annular horn shaped member having a flared outer surface.

3. The combination of claim 1 wherein said first ring means is attached intermediate the ends of said rods, the second ring means and said collar member being attached to the opposite ends of said rods.

4. The combination of claim 1 wherein said ring means define planes of intersection substantially equal to 60°.

5. The combination of claim 1 wherein said means for attaching the ring means to a deck comprise an attachment plate cooperatively engaging said support member means.

6. The combination of claim 1 wherein said ring means define a cleat for a deck surface and said collar member is positioned outward and downward from said cleat below the level of the deck surface.

7. The combination of claim 1 wherein said rods and ring means are attached to a deck and wherein the rod extensions are inclined downwardly from the deck with the collar member positioned below the plane of the deck.

* * * * *